US006341897B1

(12) United States Patent
Palzer et al.

(10) Patent No.: US 6,341,897 B1
(45) Date of Patent: Jan. 29, 2002

(54) ROLL SUPPORT FRAME WITHOUT HOUSING

(75) Inventors: Otmar Palzer, Jüchen; Erich Grossmann, Tönisvorst, both of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/551,173

(22) Filed: Apr. 17, 2000

(30) Foreign Application Priority Data

Apr. 20, 1999 (DE) ..... 199 17 769
Jan. 20, 2000 (DE) ..... 100 02 143

(51) Int. Cl.[7] ..... F16C 19/26
(52) U.S. Cl. ..... 384/559; 72/238; 72/239
(58) Field of Search ..... 384/559, 584, 384/537; 72/238, 239

(56) References Cited

U.S. PATENT DOCUMENTS 4,944,175 A * 7/1990 Svagr et al.
5,660,068 A * 8/1997 Yamamoto et al.

FOREIGN PATENT DOCUMENTS

| | | |
|---|---|---|
| DE | 1527674 | 1/1970 |
| DE | 2907398 | 9/1979 |
| DE | 3132339 | 12/1988 |
| EP | 0188348 | 7/1986 |
| EP | 0272050 | 6/1988 |
| EP | 0659495 | 6/1995 |

* cited by examiner

*Primary Examiner*—Lenard A. Footland
(74) *Attorney, Agent, or Firm*—Friedrich Kueffner

(57) ABSTRACT

A roll support frame without housing for pairs of rolls is supported on two sides in bearing chocks, wherein the roll support frame can be moved into and out of a unilaterally open housing which contains the drive transmission and adjusting devices for the rolls. The roll support frame is composed of a box-shaped element with entry and exit passages, guides for the rolling stock and support and guide elements arranged at the box-shaped element for the bearing chock pairs of each of the two rolls.

7 Claims, 5 Drawing Sheets

ROLL SUPPORT FRAME WITHOUT HOUSING

BACKGROUND OF THE INVENTION

1. Field of the Invention

The present invention relates to a roll support frame without housing for pairs of rolls supported on two sides in bearing chocks, wherein the roll support frame can be moved into and out of a unilaterally open housing which contains the drive transmission and adjusting devices for the rolls.

2. Description of the Related Art

Numerous embodiments of roll stand arrangements have become known in the art in which two-high roll stands are pushed into unilaterally open housings, so-called C-housings, and are locked and connected to the drive elements which are fixedly mounted in the housing. The roll stands were either complete beam or joist roll stands or cassette-type stands which support the roll pairs. The beam roll stands are usually equipped with their own adjusting devices arranged in the stand, wherein, after the stand has been moved into the housing, the adjusting devices are connected to appropriate control elements, as disclosed, for example, in DE-OS 1 527 674 and 2 907 398. However, it has also already been proposed to arrange the adjusting devices not in the beam roll stand or in the stand cassette, but in the stationary housing itself, wherein the adjusting devices were then connected to the bearing chocks of the rolls of the stand or stand cassette which has been moved in, as disclosed in German Patent 3 132 339.

These known embodiments are all difficult to manufacture and they are cumbersome to operate and they require significant maintenance.

SUMMARY OF THE INVENTION

Therefore, it is the primary object of the present invention to provide a roll support frame without housing which is composed of a few modular structural components which can be manufactured easily, can be exchanged against each other and require little maintenance.

The present invention starts from a proposal disclosed in EP 639 495 A2, in which the rolls of a two-high roll pair of a roll support frame without housing are supported in bearing chocks which are guided in guide means fixedly connected to the support frame so as to be movable towards each other and away from each other and which are connected to each other by a pair of threaded spindles which extend through the chocks, wherein the pair of threaded spindles are externally driven for effecting the adjusting movements of the bearing chocks.

In accordance with the present invention, the above object is met by a roll support frame which is composed of a box-shaped element with entry and exit passages, guide means for the rolling stock and support and guide elements arranged at the box-shaped element for the bearing chock pairs of each of the two rolls.

In accordance with another feature of the present invention, a roll adjusting device each can act on the two bearing chocks of one or the other roll of the two-high roll pairs when the roll support frame is moved into the housing.

In accordance with the invention, the support and guide elements for the bearing chock pairs may be composed of cylindrical bolt pairs guided in bores in the bearing chocks, wherein the pairs of cylindrical bolts are held by cantilever projections arranged laterally at the box-shaped element, and wherein the pairs of cylindrical bolts are supported in the bores and spring-biased with their end faces against the bearing chocks.

In accordance with an advantageous feature, stops can be arranged at the two side walls of the box-shaped element, wherein, when the roll support frame is moved into the housing, the stops can be clamped against locking elements arranged in the oppositely arranged side walls of the housing. On its front side facing the housing, the roll support frame may have media coupling elements.

The rolls of the two-high roll pair may each have a coupling bore for the insertion of a coupling bolt having a polygonal cross-section. The adjusting movements of the adjusting devices acting on the bearing chocks of the rolls can be controlled by computing devices influenced by measured values and fixed values.

The configuration of the roll support frame according to the present invention results in simple, compact roll modules with integrated rolling stock guide means which can be manufactured inexpensively and can be combined without changes to form cluster stand arrangements in which the number of stands can be changed and the individual stands can be exchanged against each other. Preferably used in these stands are small single-groove rolls with simple bearings whose supports can be without play in the axial direction.

Since the roll module does not have its own adjusting devices and its bearing chocks can be acted on by adjusting devices contained in the housing, it is possible, particularly when hydraulically actuated and controlled adjusting devices are used, to put together a roll stand arrangement in which rolling force measurements utilizing the hydraulics of the adjusting device, zeroing and calibrating and the computing devices influenced by measurement values and fixed values make possible a presetting of the rolls, for example, for precision rolling or sizing. In addition, such an adjustment control makes possible the solution of problems, such as adjustment repetitions, storing of adjusting data; also, changeable overload protections can be provided. The polygonal cross-section of the coupling bores of the rolls and of the coupling bolt makes possible a quick and secure coupling of the rolls to the drive spindles, wherein the coupling can also be quickly released; this simple configuration of the roll modules makes it possible that these roll modules may be reconfigured and adjusted in the area of the rolling train.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
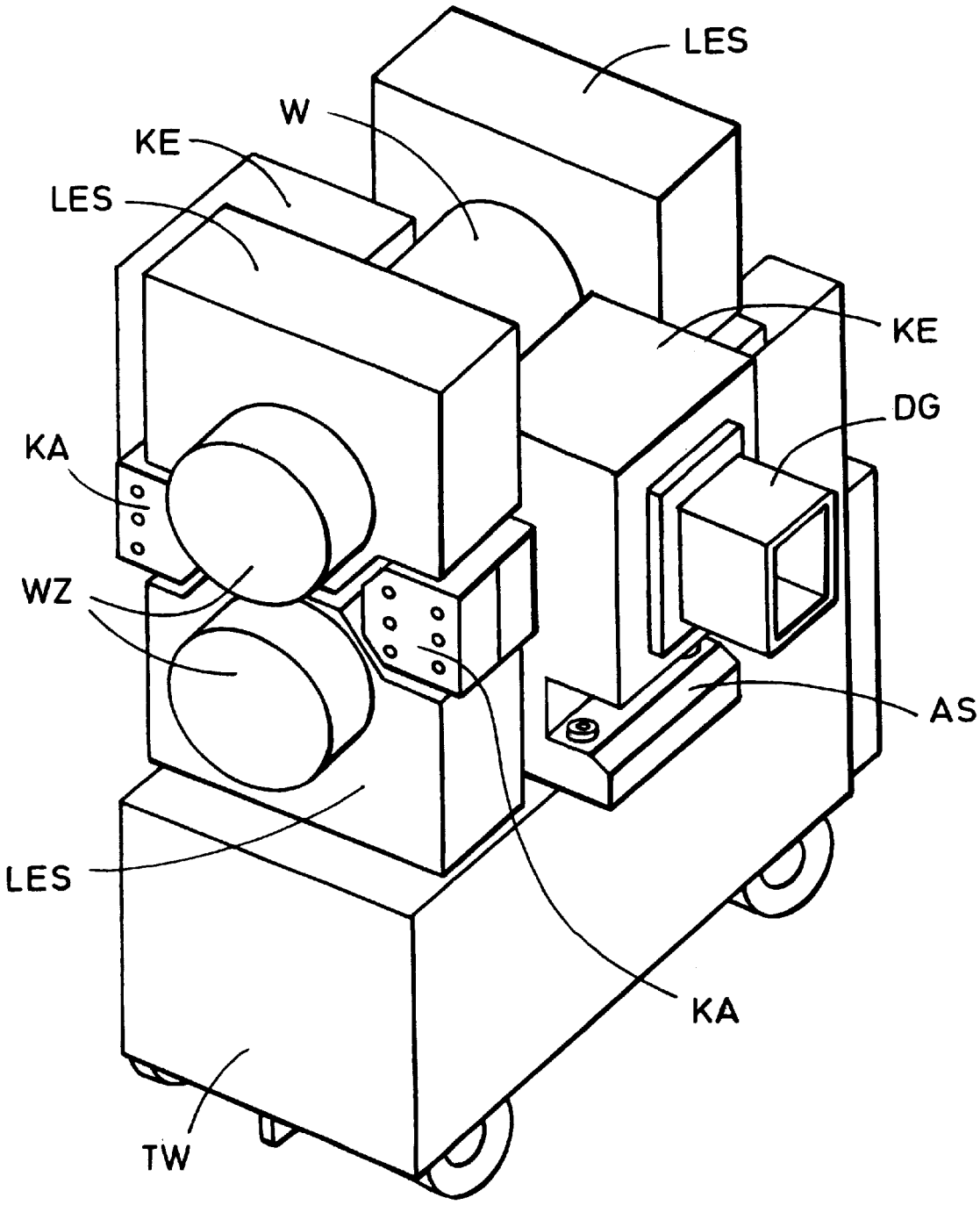
FIG. 1 is a schematic perspective view of the roll support frame according to the present invention.
Figure 2:
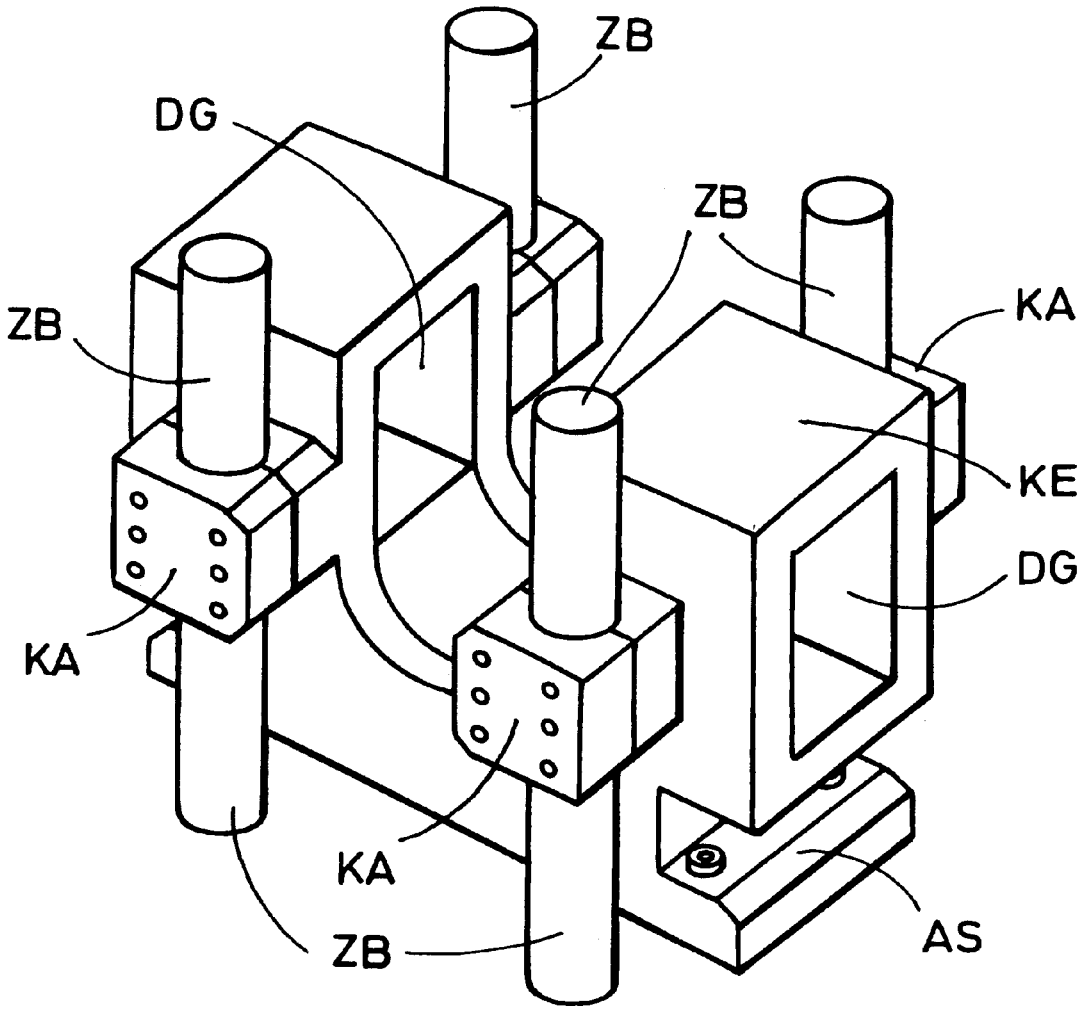
FIG. 2 is a schematic perspective view of a detail of the roll support frame of FIG. 1.
Figure 3:
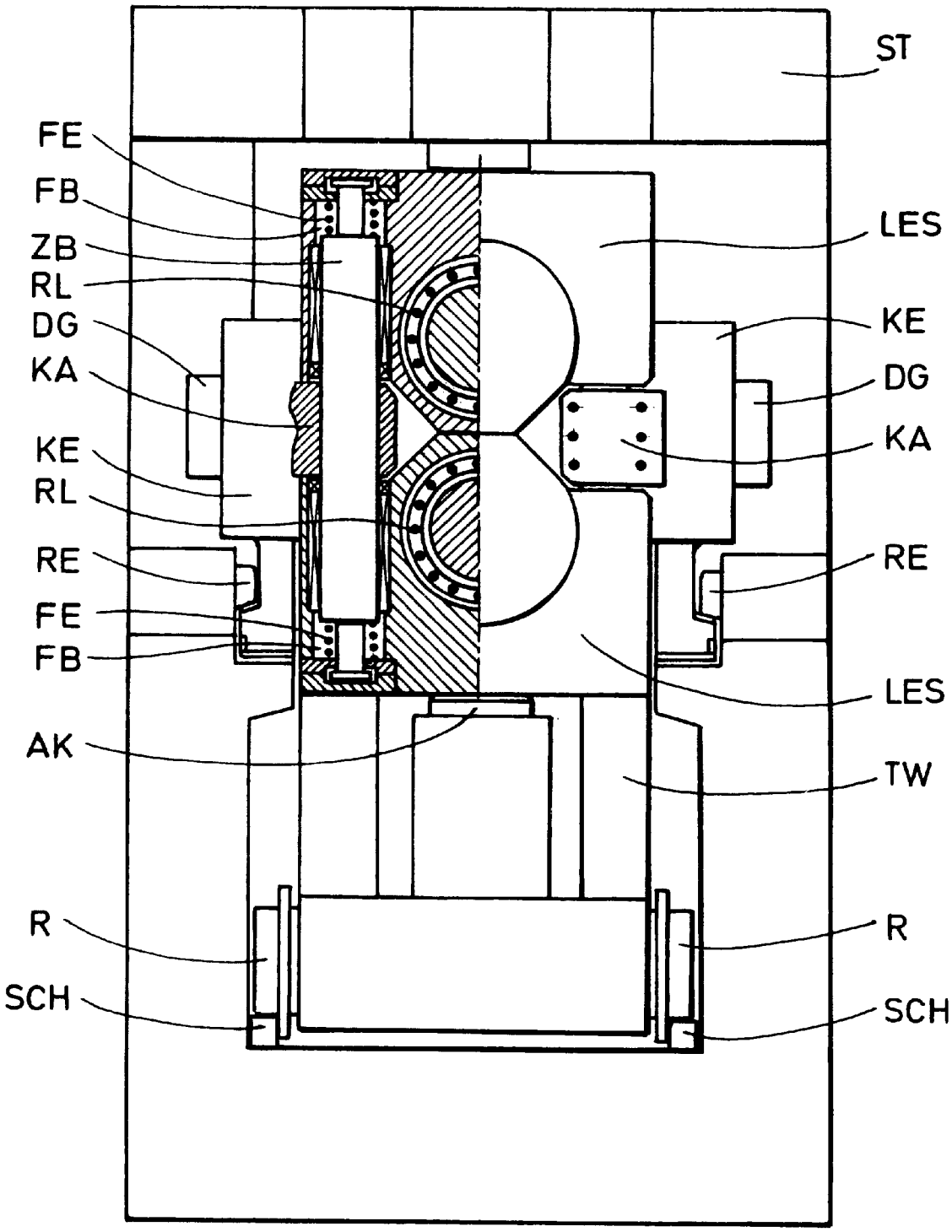
FIG. 3 is a side view, partially in section and in the direction of the roll axes, of the roll support frame moved into the housing.

As illustrated in FIGS. 1, 2 and 3, a box-shaped element KE is placed on a support carriage TW. The box-shaped element KE has passages DG with additional guide elements, not shown, for the rolled strand, also not shown, which enters from one side and exits at the other side. The two passages DG are arranged at a distance from each other in the direction of movement of the rolling stock. Two cantilever projections KA which are also arranged at a distance from each other are mounted on the two outer sides of the box-shaped element extending parallel to the travel direction of the rolling stock and approximately on the level of the horizontal exit plane of the two passages DG.

As seen in FIG. 2, cylindrical bolts ZB are clamped into the cantilever projections KA, wherein the cylindrical bolts ZB extend parallel to each other and perpendicularly of the horizontal center plane of the passages DG.

As shown in FIG. 3, the upper and lower bearing chocks LES with guide bores FB are placed and guided on the cylindrical bolts ZB. Mounted in the ends of the guide bores FB are spring elements FE which act on the end faces of the cylindrical bolts ZB. The upper and lower rolls W of the two-high roll pair are mounted in roller bearings RL in the bearing chocks LES. Arranged below the passages DG and extending transversely of the passages DG are stops AS which, as shown in FIG. 3, are acted upon by locking elements RE which are arranged in the oppositely located side walls of the housing ST. The support carriage TW has rollers R on which the support carriage TW can be moved into and out of the housing ST on rails SCH.

Additionally arranged in the housing are adjusting pistons AK which are hydraulically actuated in a manner which is not illustrated and are freely placed on the upper and lower bearing chocks LES and act on the bearing chocks.

Figure 4:
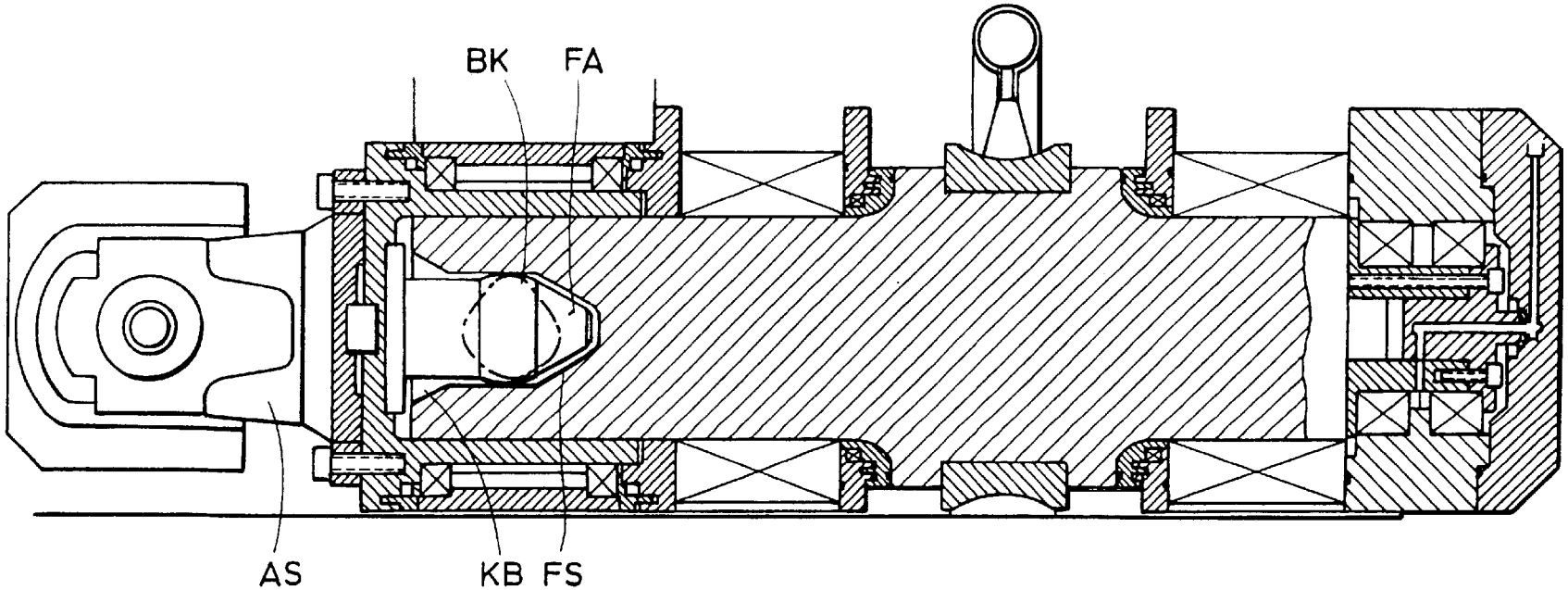
FIG. 4 is an illustration of a detail on a larger scale and partially in section.

FIG. 4 shows the configuration of the coupling bolt BK of a drive spindle AS which has a polygonal cross-section and can be inserted into the coupling bore KB of the roll W. The coupling bolt BK has at its end face a truncated cone-shaped guide projection FA which, in the illustrated coupling position, engages in a correspondingly shaped bore extension FS of the coupling bore KB.

Figure 5:
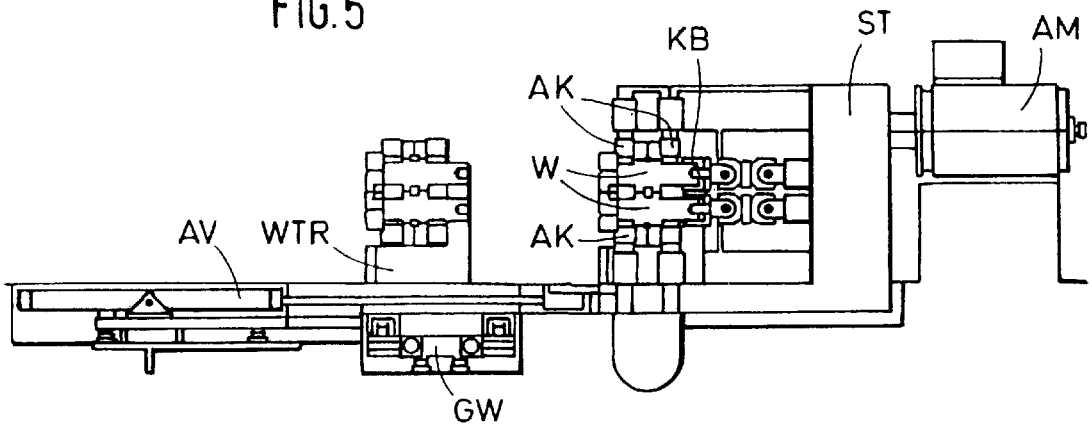
FIG. 5 is a schematic view of the roll support frame with the housing in the rolling direction.

FIG. 5 shows the interaction of the roll support frame WTR with the housing ST. The rolling train, not shown, was previously stopped, the media couplings were disconnected and the stops AS illustrated in FIG. 3 and the locking elements RE were separated. Subsequently, a roll support frame to be exchanged was pulled out of the housing ST by means of the stand changing carriage GW actuated by the pulling out device AV. The roll support frame to be exchanged was then transported away. A stand change carriage GW carrying a new roll support frame WTR then moves transversely of the rolling direction into the housing ST into the illustrated position in which the housing ST and the roll support frame WTR are locked by the aforementioned stops AS and locking elements RE and simultaneously the media couplings, not shown, are connected at the front side of the roll support frame WTR to the supply lines in the housing ST. As the frame WTR is moved into the housing ST, the coupling bolts BK, shown in FIG. 4, are moved into the coupling bores KB of the rolls W and, after the rails SCH shown in FIG. 3 have been lowered, the adjusting pistons AK of the adjusting devices arranged in the housing ST are moved against the bearing chocks LES of the rolls W. After the roll change carriage GW has been moved back, the adjusting pistons AK of the adjusting device acting on the bearing chocks are used for moving the rolls W into their zero positions and for subsequently adjusting the predetermined size of the roll gap.

Figure 6:
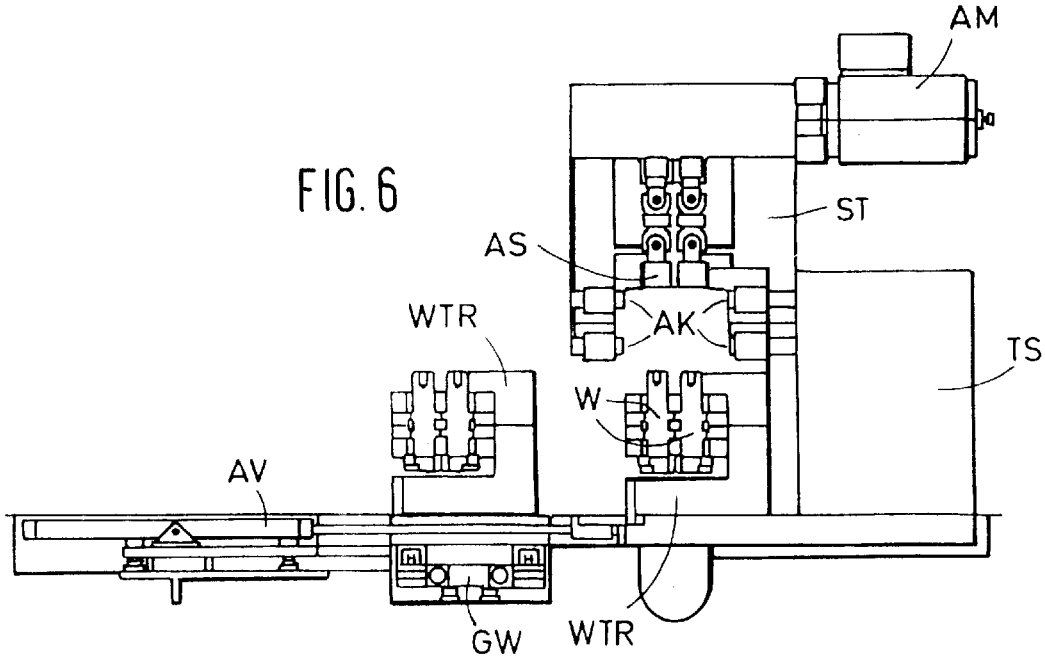
FIG. 6 is a view corresponding to FIG. 5 showing another position of the roll support frame in the housing.

The construction according to FIG. 6 corresponds to that according to FIG. 5 except that in FIG. 6 the housing ST is intended for the roll support frame WTR with a pair of vertical rolls W. In this case, the housing ST containing the drive spindles AS and the adjusting motor AM is vertically movably guided on a support bracket TS with a downwardly directed insertion opening. In this case, the roll support frame WTR is moved by the stand change carriage GW underneath the insertion opening of the housing ST which has been moved into an appropriate upper position, and the housing ST is then moved downwardly into a position in which the housing encloses and is locked to the roll support frame WTR in the same manner as illustrated in the arrangement according to FIG. 5. In this case, the drive spindles AS with the coupling bolts are moved vertically from above into the coupling bores of the rolls W and the adjusting pistons AK are moved from both sides against the bearing chocks LES of the rolls W.

While specific embodiments of the invention have been shown and described in detail to illustrate the inventive principles, it will be understood that the invention may be embodied otherwise without departing from such principles.

We claim:

1. A roll support frame without housing for two-high pairs of rolls each supported on two sides thereof in pairs of bearing chocks, wherein the roll support frame is configured to be movable into and out of a unilaterally open housing, wherein the housing contains a drive transmission and adjusting devices for the rolls, the roll support frame comprising a box-shaped element with entry and exit passages, and guide means for rolling stock, further comprising support and guide elements mounted at the box-shaped element for the bearing chock pairs of each of the two rolls.

2. The roll support frame according to claim 1, wherein the roll adjusting devices each are configured to act on the two bearing chocks of one of the rolls of the two-high roll pairs when the roll support frame is moved into the housing.

3. The roll support frame according to claim 1, wherein the support and guide elements for the bearing chock pairs are comprised of cylindrical bolt pairs guided in bores in the bearing chocks, wherein the pairs of cylindrical bolts are held by cantilever projections mounted laterally at the box-shaped element, and wherein the pairs of cylindrical bolts are supported in the bores and spring-biased with end faces thereof against the bearing chocks.

4. The roll support frame according to claim 1, further comprising a support carriage for supporting the roll support frame and configured to be movable into the open housing, further comprising stops mounted at side walls of the support carriage, further comprising locking elements mounted in oppositely located side walls of the housing and configured to clamp the stops when the support carriage is moved into the housing.

5. The roll support frame according to claim 1, further comprising a support carriage for supporting the roll support frame and configured to be movable into the housing, and media coupling elements mounted at a front side of the support carriage facing the housing.

6. The roll support frame according to claim 1, wherein each roll has a coupling bore having a polygonal cross-section for receiving a coupling bolt of a drive spindle having a corresponding polygonal cross-section.

7. The roll support frame according claim 6, wherein each coupling bolt has a truncated cone-shaped guide projection in front of the polygonal cross-section for receiving a corresponding bore extension of the coupling bore of the roll.

* * * * *